US005114395A

United States Patent [19]

Abramson

[11] Patent Number: 5,114,395

[45] Date of Patent: May 19, 1992

[54] PAPER SHEET FOLDING DEVICE

[75] Inventor: Richard J. Abramson, Glen Ellyn, Ill.

[73] Assignee: Martin Yale Industries, Inc., Wabash, Ind.

[21] Appl. No.: 498,029

[22] Filed: Mar. 23, 1990

[51] Int. Cl.[5] ..... B31F 1/00; B31F 7/00

[52] U.S. Cl. ..... 493/421; 493/420; 493/23

[58] Field of Search ..... 493/419, 420, 421, 8, 493/10, 13-14, 17-18, 23, 29, 416

[56] References Cited

U.S. PATENT DOCUMENTS

| | | | |
|---|---|---|---|
| 1,813,476 | 7/1931 | Waterworth . | |
| 2,000,636 | 5/1935 | Flynt | 270/68 |
| 2,725,228 | 11/1955 | Seward | 270/61 |
| 3,193,983 | 7/1965 | Wells | 53/117 |
| 3,242,637 | 3/1966 | Wills | 53/266 |
| 3,416,785 | 12/1968 | Sherman | 270/45 |
| 3,447,221 | 6/1967 | Odiorne | 29/121.1 |
| 3,510,122 | 5/1970 | Gavaghan | 270/68 |
| 3,514,097 | 5/1970 | Hoff | 270/61 |
| 3,516,655 | 6/1970 | Schmeck | 270/68 |
| 3,729,186 | 4/1973 | Macke | 270/68 |
| 3,796,423 | 3/1974 | Shuster | 493/421 |
| 3,975,009 | 8/1976 | Brown | 493/421 X |
| 4,167,265 | 9/1979 | Whittenberger | 270/68 |
| 4,223,882 | 9/1980 | Stocker | 493/420 X |
| 4,375,971 | 3/1983 | Moll | 493/420 X |
| 4,403,981 | 9/1983 | Wuthrich | 493/419 |
| 4,504,259 | 3/1985 | Lindenmuller | 493/23 |
| 4,573,672 | 3/1986 | Lehmann et al. | 493/420 X |
| 4,585,219 | 4/1986 | Lehmann et al. | 270/46 |
| 4,647,029 | 3/1987 | Ohmori | 270/45 |
| 4,701,155 | 10/1987 | Ott | 493/420 X |
| 4,781,667 | 11/1988 | Kitai | 493/421 |
| 4,842,574 | 6/1989 | Noble et al. | 493/421 |
| 4,850,945 | 7/1989 | Whittenberger | 493/420 |

*Primary Examiner*—Bruce M. Kisliuk
*Assistant Examiner*—John A. Marlott
*Attorney, Agent, or Firm*—Willian Brinks Olds Hofer Gilson & Lione

[57] ABSTRACT

A feed mechanism for a folding machine and a folding machine for sheet material. The folding machine has a plurality of rollers for folding sheet material, drive means for rotating said rollers, at least two pocket assemblies with microswitches positioned to be contacted by sheet material passing through said pocket assemblies. The drive means are controlled by these pocket assembly microswitches and a cam microswitch, which is contacted by a cam attached at one end of a roller.

The feed mechanism consists of a roller flat having a curved side and a flat side. Between the flat side and a second roller, a gap is formed allowing sheet material to be inserted directly into a first pocket assembly. The sheet material thus inserted contacts a microswitch located in the pocket assembly activating the drive means which turns the roller flat so that its curved side forms a take-in nip with the second roller, feeding the paper in further to begin the folding process.

12 Claims, 2 Drawing Sheets

PAPER SHEET FOLDING DEVICE

BACKGROUND OF THE INVENTION

This invention relates to a folding machine for folding sheet material. Folding devices using stops and rollers to create buckles in the sheet material which are drawn into roller pairs forming a fold, are common in the art. Typically, however, the delivery of the sheet material to the folding rollers is accomplished by a feed system which directs sheet material into the roller pairs. For example, a feed roller, a feed roller with guide plate, a sheet guideway, and a delivery or feed table are some of the various means of directing the sheet material to the folding roller pairs.

Also disclosed in the art are the use of sensory and cam switches which activate the motor powering the rollers.

The problem with these folding members and others is that a number of individual parts are required for the delivery means. This increases the time and labor required to assemble the paper folder which in turn increases the cost of the paper folder.

The present invention is directed to a folding machine that has few parts and is easy to assemble. This will result in a folding machine that has a lower cost than conventional folding machines. By use of a simplified delivery system and microswitch control system, the present invention provides an inexpensive and easy to use folding machine.

SUMMARY OF THE INVENTION

This invention provides a folding machine for sheet material comprising a plurality of rollers for folding sheet material, drive means for rotating the rollers, at least two pocket assemblies, at least two pocket assembly microswitches positioned to be contacted by sheet material passing through the pocket assemblies, a cam, and a cam microswitch. In addition this invention provides for a fed system comprising a roller flat, a second roller, the first pocket assembly and first pocket assembly microswitch.

The roller flat has a flat side and a curved side. The roller flat allows sheet material to be inserted between it and a second take-in roller when the flat side faces the second roller.

The first pocket assembly receives sheet material inserted between the roller flat and the second roller. The first pocket assembly microswitch is activated when sheet material passes into the first pocket assembly. The first pocket assembly microswitch activates a drive means which turns the roller flat so that the curved side forms a take-in nip with the second roller. This forces the sheet material into the first pocket assembly causing the sheet to buckle. The buckled sheet is then fed through additional rollers creating a folded sheet.

The cam is attached to one end of the roller flat. The cam microswitch activates and deactivates the motor as the roller flat rotates. When its flat side faces the second roller, the cam microswitch is deactivated.

One objective of the invention is to provide a simple, inexpensive design to allow insertion of sheet material into the rollers without a feeding system or track. The invention, however, will operate with optional features including an automatic paper feeder and a manual dejamming mechanism.

A further objective of the invention is to provide a paper folder that has no dependency on gravity, and thus can be conveniently mounted in any position.

A still further objective of the invention is to provide a simple means of activating and deactivating the motor of the folding device.

These and other objectives are achieved by the present invention.

DETAILED DESCRIPTION OF AN EMBODIMENT

Figure 1:
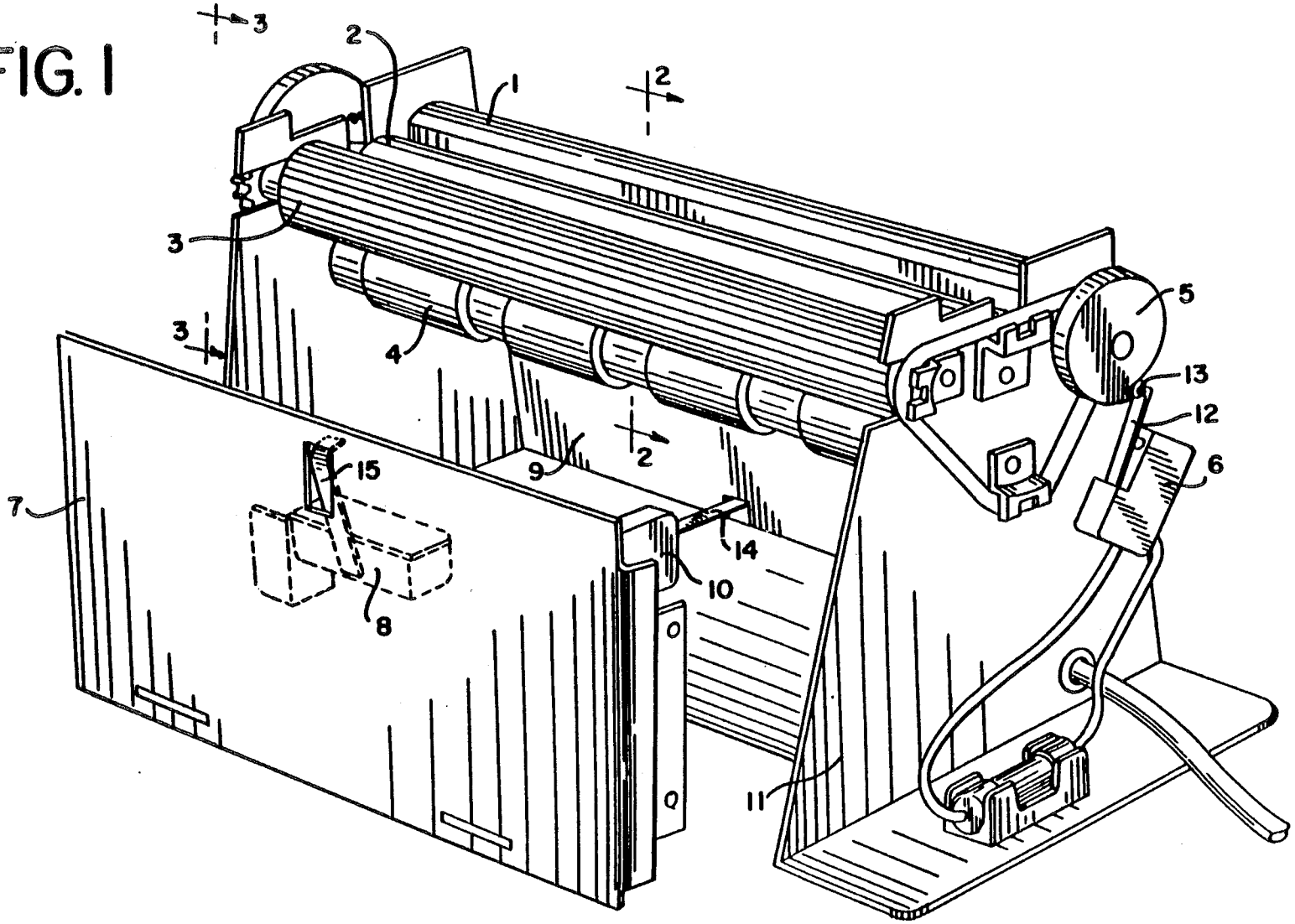
FIG. 1 is a partly exploded perspective view of the paper folder.

Referring to FIG. 1, the folding machine is shown in perspective view with a second pocket assembly 7 removed from the frame 11. The locations of the three microswitches are also shown. A first pocket assembly microswitch 10, has a lever 14 which extends through an opening in the first pocket assembly 9. A second pocket assembly microswitch 8 has a curved lever 15 which extends between an opening in the second pocket assembly 7. A cam 5 integral with roller flat 1 is positioned to operate cam microswitch 6. The cam microswitch has a lever 12 with a cam roller 13 which contacts the cam 5.

Figure 2:
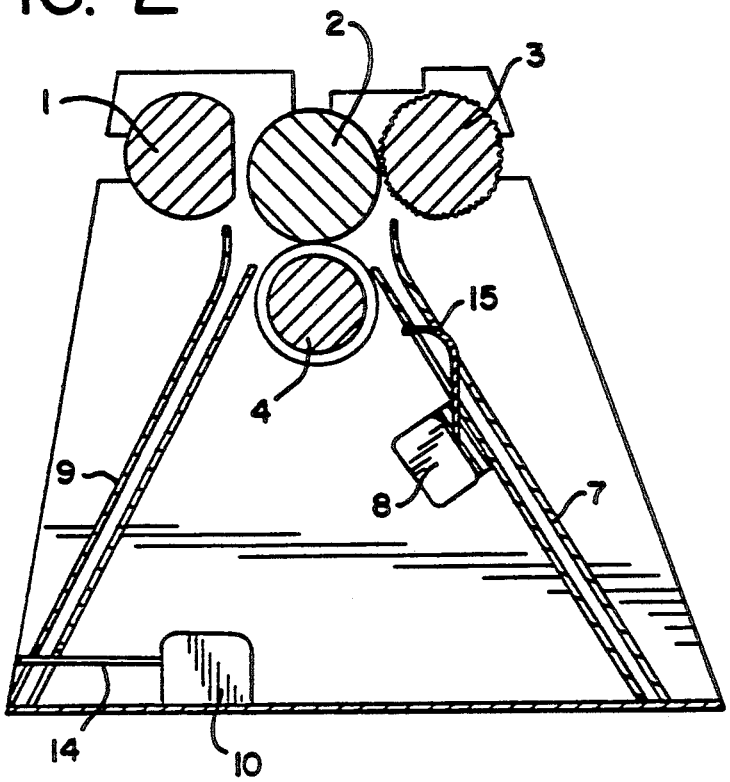
FIG. 2 is a sectional view taken along the axis 2—2 illustrating a four roller paper folder.

Referring to FIG. 2, four rollers are arranged to form three roller pairs. Roller flat 1 and rubber take-in roller 2 make up the first pair, grooved roller 4 and rubber take-in roller 2 make up the second pair, and rubber take-in roller 2 and knurled roller 3 make up the third pair. The exterior of the roller flat is flat on one side and curved on the other; as it rotates only the curved exterior portion forms a take-in nip with rubber take-in roller 2. When the flat portion faces the rubber take-in roller 2, a feed gap is formed. This gap allows sheet material to be inserted in the first pocket assembly 9.

Figure 3:
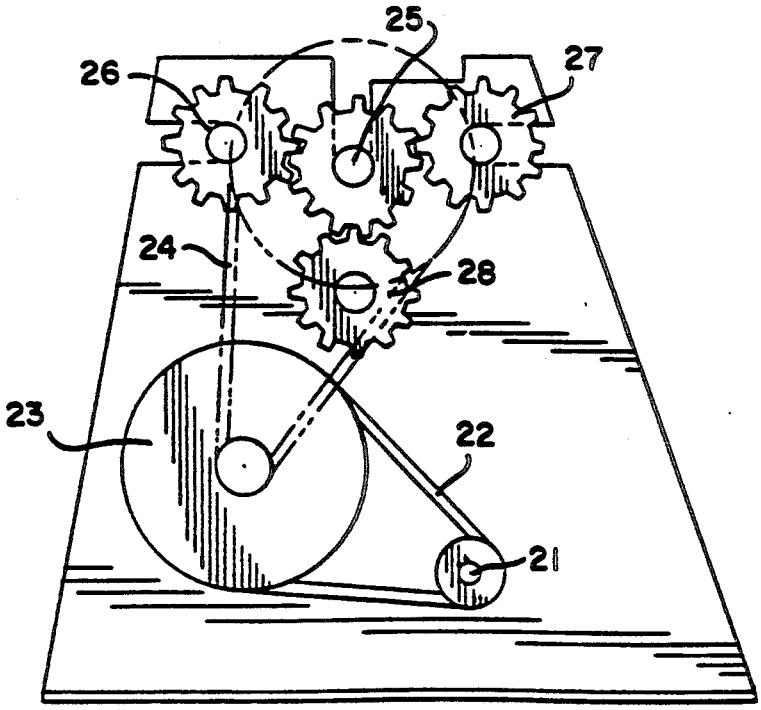
FIG. 3 is a schematic side view of a drive mechanism of said folder.

Referring to FIG. 3, the drive means consist of a gear and belt assembly attached to a pulley motor 21. The pulley motor 21 is coupled via a first timing belt 22 with double step timing pulley 23. The double step timing pulley 23 is coupled via a second timing belt 24 to a combination spur gear timing pulley 25 which is integral with rubber take-in roller 2. The spur gear of the combination spur gear timing pulley 25 is engaged with spur gears 26 integral with roller flat 1, 27 integral with knurled roller 3, and 28 integral with grooved roller 4. When activated, the roller flat 1, knurled roller 3, and grooved roller 4 all rotate clockwise; whereas, the rubber take-in roller 2 rotates counterclockwise.

In operation, paper to be folded is inserted into the feed gap between roller flat 1 and rubber take-in roller 2. The sheet material enters the first pocket assembly 9, and near its end contacts and closes a first pocket assembly microswitch 10, as shown in FIG. 2. This activates a pulley motor 21 causing the rollers to rotate. As roller flat 1 rotates, a cam 5 integral with the roller flat contacts and closes a cam microswitch 6. As the roller flat continues to rotate around, the feed gap is closed and the take-in nip is created between the curved exterior portion of the roller flat 1 and rubber take-in roller 2. Sheet material caught in the take-in nip is forced further and buckles when the leading edge hits the end of the first pocket assembly 9.

The buckle is caught by a first folding nip formed by the second roller pair 2, 4, and pulled through into second pocket assembly 7, creating a first fold. As the sheet material is pulled out of the first pocket assembly 9 the first pocket assembly microswitch 10 is opened. The leading edge of the first fold is forced toward second pocket assembly microswitch 8 near the top of second pocket assembly 7, as shown by FIG. 2. The first fold edge contacts and closes second pocket assembly microswitch 8. The roller flat 1 at this point has made one revolution, and the cam microswitch 6 is opened.

The sheet material continues to be fed until the first fold edge hits the second pocket assembly end. At this point, the sheet material buckles a second time and is caught in a second folding nip formed by the third roller pair 2, 3. During this process the rollers have made a second and third revolution, and the cam microswitch 6 has been closed and opened upon each revolution. The sheet material is pulled through the second roller pair, creating a second fold in the sheet material.

As the sheet material leaves the second pocket assembly 7, the second pocket assembly microswitch 8 is opened. Simultaneously, the cam microswitch 6 is closed. The folded sheet material is then ejected from the folder. As the rollers complete a fourth revolution, the cam microswitch 6 again opens, deactivating the pulley motor 21. The roller flat 1 realigns in the original position where the flat portion faces rubber take-in roller 2.

I claim:

1. A feeding mechanism for a folding machine comprising:

a roller flat having a circumference including a flat side and a curved side;

a take-in roller adjacent to the roller flat so as to define a feed gap when the flat side of the roller flat faces the take-in roller, and a take-in-nip when the curved side of the roller flat faces the take-in roller;

a first pocket assembly having an open end and a closed end, said open end located downstream of said feed gap; and a first pocket assembly microswitch in contact with said first pocket assembly.

2. The apparatus of claim 1, further comprising a cam attached at one end of said roller flat and a cam microswitch in contact with said cam.

3. The apparatus of claim 1, wherein said first pocket assembly microswitch is disposed at said closed end of said first pocket assembly.

4. The apparatus of claim 1, wherein said first pocket assembly microswitch has a lever, said lever extending through an opening formed in said first pocket assembly.

5. A folding machine for sheet material comprising:

a frame;

at least first, second, third, and fourth rollers rotatably mounted to said frame, said roller extending parallel to each other, said first roller having a circumference including a flat side and a curved side, said second roller adjacent to said first roller so as to define a feed gap when said flat side of said first roller faces said second roller, and a take-in-nip when said curved side of said first roller faces said second roller, said third roller adjacent to said second roller so as to define a first fold nip, said fourth roller adjacent to said second roller so as to define a second fold nip;

means for driving said first, second, third and fourth rollers;

a first pocket assembly attached to said frame, said first pocket assembly disposed downstream from said feed gap and upstream from said first folding nip, said first pocket assembly having an open end and a closed end;

a first pocket assembly microswitch in contact with said first pocket assembly;

a second pocket assembly attached to said frame, said second pocket assembly disposed downstream of said first folding nip, said second pocket assembly having an open end and a closed end;

a second pocket assembly microswitch in contact with said second pocket assembly;

a cam attached at one end of said first roller, said cam having an expanded area on one side of said cam; and a cam microswitch in contact with said cam.

6. The apparatus of claim 4, further comprising a housing for placement over said frame, said housing having a sheet material in-take opening and a sheet material discharge opening.

7. A folding machine for sheet material comprising:

a frame;

a plurality of rollers attached to said frame, said rollers forming at least first, second and third roller pairs, said first roller pair being formed by a roller flat and a take-in roller, said roller flat having a circumference including a flat side and a curved side, said take-in roller adjacent to said roller flat so as to define a feed gap when said flat side of said roller flat faces said take-in roller, and a take-in nip when said curved side of said roller flat faces said take-in roller, said second roller pair being formed by said take-in roller and a first fold roller, said first fold roller adjacent to said take-in roller so as to define a first fold nip, said third roller pair being formed by said take-in roller and a second fold roller, said second fold roller adjacent to said take-in roller so as to define a second fold nip;

means for driving said rollers;

a first pocket assembly attached to said frame;

said first pocket assembly having an open end and a closed end, said open end disposed downstream of said take-in nip;

a first pocket assembly microswitch in contact with said first pocket assembly;

a second pocket assembly attached to said frame, said second pocket assembly having an open end and a closed end, said open end disposed downstream of said first fold nip;

a second pocket assembly microswitch in contact with said second pocket assembly;

a cam attached to one end of said roller flat; and a cam microswitch in contact with said cam.

8. The apparatus of claim 7, wherein said cam microswitch has a lever, said lever having a cam roller rotatably mounted at one end of said lever, said cam roller contacting said cam.

9. The apparatus of claim 7, wherein said second pocket assembly microswitch has a curved lever extending through an opening formed in said second pocket assembly.

10. The apparatus of claim 7, wherein said take-in roller has a rubber surface.

11. The apparatus of claim 7, wherein said first fold roller has a grooved surface.

12. The apparatus of claim 7, wherein said second fold roller has a knurled surface.

* * * * *

UNITED STATES PATENT AND TRADEMARK OFFICE

CERTIFICATE OF CORRECTION

PATENT NO. : 5,114,395
DATED : May 19, 1992
INVENTOR(S) : Richard J. Abramson

It is certified that error appears in the above-indentified patent and that said Letters Patent is hereby corrected as shown below:

In column 1, line 41, delete "fed" and substitute therefor --feed--.

In column 3, line 58, delete "roller" and substitute therefor --rollers--.

Signed and Sealed this

Twentieth Day of September, 1994

*Attest:*

*Attesting Officer*

BRUCE LEHMAN

*Commissioner of Patents and Trademarks*